US005302963A

United States Patent [19]

Wiggenhorn

[11] Patent Number: 5,302,963

[45] Date of Patent: Apr. 12, 1994

[54] RETRACTABLE ANTENNA ASSEMBLY WITH CONNECTOR

[75] Inventor: James T. Wiggenhorn, Coral Springs, Fla.

[73] Assignee: Motorola, Inc., Schaumburg, Ill.

[21] Appl. No.: 987,590

[22] Filed: Dec. 8, 1992

Related U.S. Application Data

[63] Continuation of Ser. No. 753,503, Sep. 3, 1991, abandoned.

[51] Int. Cl.[5] ..... H01Q 1/10; H01Q 1/24

[52] U.S. Cl. ..... 343/901; 343/702

[58] Field of Search ..... 343/901, 702, 900, 883, 343/715; 439/916; H01Q 1/10, 1/24

[56] References Cited

U.S. PATENT DOCUMENTS

| | | | |
|---|---|---|---|
| 2,491,629 | 12/1949 | Vernier et al. | 343/901 |
| 3,735,932 | 2/1956 | Textrom et al. | 343/901 |
| 4,523,197 | 6/1985 | Imazeki et al. | 343/901 |
| 4,525,718 | 6/1985 | Imazeki et al. | 343/901 |
| 4,611,213 | 9/1986 | Johnson et al. | 439/916 |
| 5,072,230 | 12/1991 | Taniyoshi et al. | 343/715 |
| 5,079,558 | 1/1992 | Koike | 343/901 |

*Primary Examiner*—Donald T. Hajec
*Assistant Examiner*—Hoanganh Le
*Attorney, Agent, or Firm*—Pedro P. Hernandez

[57] ABSTRACT

A retractable antenna assembly with connector (200) allows communication devices that require the use of more than one type of antenna element (114), to easily store the normally used antenna element (114) inside of a housing (134) which is part of the antenna assembly (200). Once inside the housing (134), the antenna element (114) forms a half wave cavity that has a high impedance at the operating frequency of the communication device (302), thereby operatively decoupling the antenna element (114) from the radio frequency path. Once inside of housing (134), antenna element (114) forms part of a coaxial connector (112) with the top portion (116) of antenna element (114) forming the center conductor of the coaxial connector (112). Thereby allowing for an external antenna element (308) to be attached to the communication device (302).

19 Claims, 2 Drawing Sheets

RETRACTABLE ANTENNA ASSEMBLY WITH CONNECTOR

This is a continuation of application Ser. No. 07/753,503, filed Sep. 3, 1991, and now abandoned.

TECHNICAL FIELD

This invention relates to antennas, and more specifically to a retractable antenna assembly having an integral antenna connector.

BACKGROUND

In many radio communication applications it becomes necessary to disconnect the communication device's antenna and connect a different antenna, usually an antenna having better gain characteristics. This is typically the case with transportable radios, where the standard antenna that is used by the radio is usually removed, or somehow disconnected from the radio frequency path, in order to connect a mobile mount antenna upon the radio user entering a vehicle. The problem with disconnecting the antenna from the radio and reconnecting a new one is that the radio user then has to worry about not losing the antenna that has been removed. Another problem occurs in certain types of radios where the antenna has to be removed in order to run operational tests, such as power output tests, which cause the radio user to have to remove the antenna in order to perform the tests.

A need exits for an antenna assembly which can overcome the above mentioned problems associated with present day radio antenna assemblies.

SUMMARY OF THE INVENTION

Briefly described, the present invention contemplates a retractable antenna assembly which allows for the attachment of an external antenna when the antenna element is in the retracted position.

According to the invention, an antenna assembly comprises an antenna feed point and a housing including a dielectric sleeve. The antenna assembly further includes an antenna element coupled to the antenna feed point and carried by the housing, the antenna element being movable between a first position wherein the antenna element forms an active antenna portion and a second position substantially within the dielectric sleeve wherein the antenna element is operatively decoupled from the antenna feedpoint.

In another aspect of the present invention a communication device utilizing an antenna assembly is described.

DETAILED DESCRIPTION OF THE PREFERRED EMBODIMENT

Figure 1:
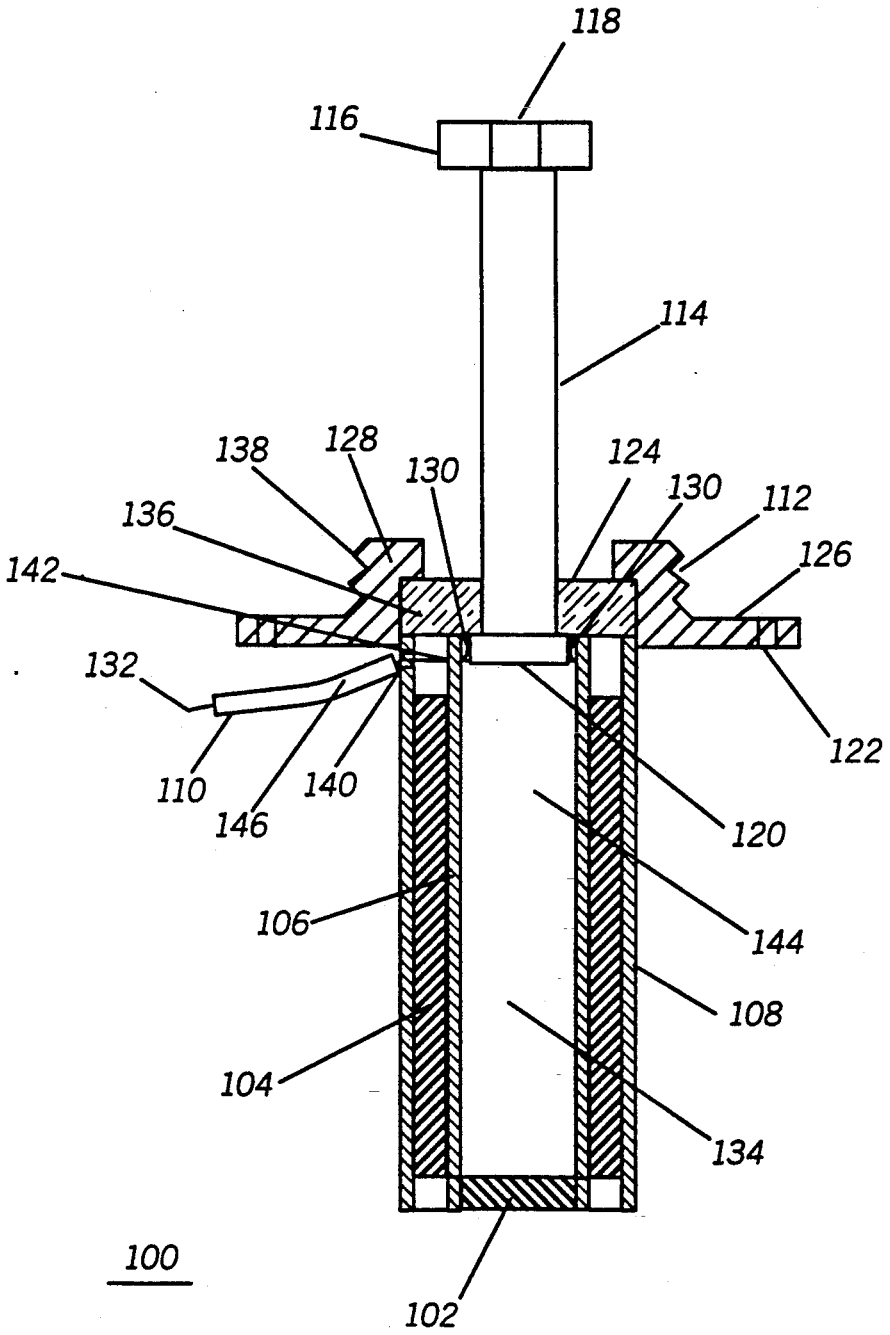
In FIG. 1 an antenna assembly in accordance with the present invention is shown.

Referring now to the drawings and in particular to FIG. 1, there is shown an antenna assembly 100 in accordance with the present invention. Antenna assembly 100 comprises a connector means 112 which can take a form similar to a conventional UHF antenna connector, such as the industry standard UL-259 connector. Connector means 112 includes a support section 126 having apertures 122 which are used to fasten the antenna assembly 100 to a radio housing (not shown). Connector means 112 also includes an insulator 136 such as a conventional low loss insulator as known in the art, in order to insulate the center conductor, which is formed by antenna element 114, from "shorting" to the outside portion (or first connector contact) 128 of connector means 112, which in the preferred embodiment is at ground potential. A threaded portion 138 is also part of connector means 112 and provides for the connection to an external antenna or RF cable.

Antenna element 114 includes a top portion 116 having a conductor coupling means 118 which can take the form of a cavity within top portion 116 (the use of coupling means 118 will be discussed later in the description). Antenna 114 also includes a bottom portion 120 which engages to an antenna contact means 130 which helps maintain antenna 114 in the first, or active position, when antenna 114 is pulled up from housing 144. Antenna element 114 reaches its maximum height when antenna bottom portion 120 presses against the bottom portion of insulator 136. Antenna element 114 is preferably manufactured from an electrical conductive material such as aluminum or other similar metal.

Contact means 130 couples with the bottom antenna portion 120 at antenna feed point 142, thereby providing an electrical connection with the center conductor 132 of RF cable 110 (which is usually coupled to a communication receiver and/or transmitter). Antenna feed point 142 is the location in the center conductor sleeve 106 where center conductor 132 is attached (e.g. soldered, mechanically fastened, etc.). An opening in the outer sleeve 108 allows center conductor 132 of RF cable 132 to go through the sleeve without making electrical contact, thereby preventing the center conductor 132 from "shorting" to the outer sleeve 108 which is at ground potential. The outer conductor (ground shield) 146 of cable 110 is connected to the outer sleeve 108 at ground connection point 140 thereby putting outer sleeve 108 at ground potential. Contact means 130 is designed as a set of compressible metal fingers as known in the art, which forces a friction fit with the bottom portion 120 of antenna 114, when antenna 114 is in the first or active position ("up" position). Contact means 130 is electrically coupled to antenna feedpoint 142, and center conductor sleeve 106. The contact means 130 constantly makes contact with antenna element 114 (either in the active or retracted position), by expanding or contracting the metal fingers. Contact means 130 can also be designed by forming a threaded portion (not shown) on the top portion of center conductor sleeve 106 which the bottom portion 120 of antenna element 114 can thread into, for example by turning antenna element 114 a quarter turn when it reaches its maximum operational height. The threading method would also require having a way of making contact to antenna element 114 at all times in order to electrically couple antenna feed point 142 to antenna element 114. Attached to connector means 112 is housing 144 which includes a cylindrical outside sleeve 108 which is connected to connector contact 128 and is at ground potential.

A cylindrical center conductor sleeve 106 is also part of housing 144 and it helps form an inner cavity 134 for antenna element 114 to reside in, when antenna element 114 is in the retracted (second) position. Center conductor sleeve 106 is coupled to antenna 114 when antenna 114 is in either the "up" position or "down" retracted position since contact means 130 is coupled to the center conductor sleeve 106. Between the center conductor sleeve 106 and the outside sleeve 108 is found a cylindrical dielectric sleeve 104, which in the preferred embodiment has a dielectric constant of 4. The dielectric sleeve 104 may be formed from a material such nylon, or acetal, or other suitable materials known in the art. If a different dielectric constant is required (e.g. designing for a different operational frequency) a different material having the dielectric properties needed can be used.

The bottom portion of housing 144 includes a biasing means 102 which helps bias antenna element 114 upwardly when antenna element 114 is placed in the retracted (second) position. This helps the radio user pull the antenna element 114 out from cavity 134 when the user wants to place the antenna element in the active or first position, since the bias means 102 pushes top portion 116 above insulator top surface 124. Bias means 102 can be any resilient member such as rubber or a spring member which can provide upward bias to antenna element 114. Bias means 102 should be made from a nonconductive material such as resilient rubber, a plastic spring, etc. Bias means 102 can be friction fit within the diameter of center conductor sleeve 106, or held by other well known mechanical means.

Figure 2:
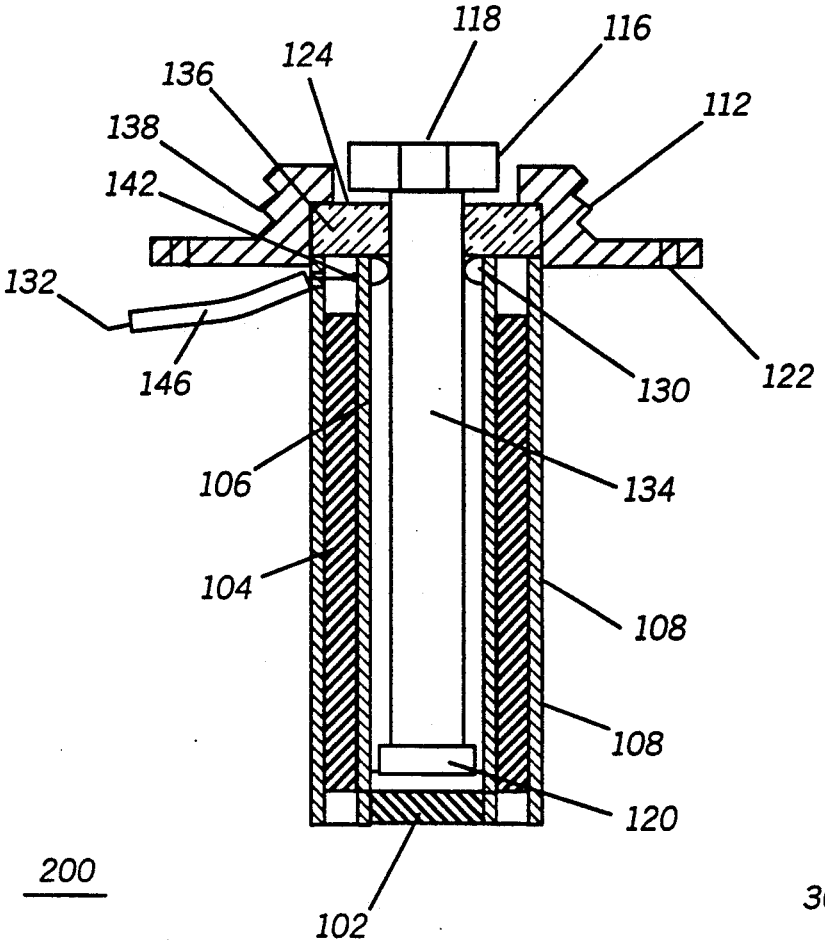
In FIG. 2 the same antenna assembly as shown in FIG. 1 is shown in the retracted position, in accordance with the present invention.

In FIG. 2, the same antenna assembly as shown in FIG. 1 is shown, this time in the retracted or down (second) position in accordance with the present invention. In the retracted position, antenna 114 forms a halfwave resonance ("cavity") that has a high impedance at the operating frequency of antenna 114. The cavity formed by outside sleeve 108, center conductor sleeve 106, and dielectric sleeve 104 causes antenna element 114 to exhibit a halfwave resonance (having approximately twice the electrical length of antenna 114). This in effect renders antenna element 114 operatively decoupled from antenna feedpoint 142 when antenna element 114 is in the second or retracted position. This allows an external antenna (not shown) to be attached to connector means 112. Coupling means 118 which is a receptacle area on the top position 116 of antenna element 114 acts as the center conductor contact (or second connector contact) for the coaxial connector formed by connector means 112, while the ground contact is provided by first connector contact 128 which is at ground potential. Any antenna which is connected to connector means 112 will automatically be electrically connected to antenna feed point 142 which will then be coupled (via RF center conductor wire 132) to the appropriate receiver and transmitter sections by RF cable 110 which will be found inside of the radio itself. Contact means 130 which is formed from compressible metal fingers expands outwardly when antenna element 114 is in the retracted (second) position in order for the contact means to make contact with the antenna element 114, thereby forming the half wave cavity.

The typical dimensions for the housing are easily calculated using an antenna design manual, or similar technical publication well known in the art. For the design of an antenna assembly 100 having an operational frequency of 450 Mhz, the calculations for the length of the half wave cavity (outside sleeve 108) are as follows:

$$L_{\lambda/2} = \frac{1}{2\sqrt{E_r}} \times \frac{300 \times 10^6}{f(\text{mhz})}$$
$$= \frac{1}{2\sqrt{4}} \times \frac{300 \times 10^6}{450 \times 10^6}$$
$$= \frac{1}{4}(.667)$$
$$= 16.67 \text{ cm} = 6.56 \text{ inch}$$

where "Er" is the dielectric constant, in this case 4.

While the calculations for the cavity diameters (diameters of outer sleeve 108 and center conductor sleeve 106) are as follows:

$$Z_o = \frac{138}{\sqrt{E_r}} \log_{10} \frac{D}{d}$$

$$50 = \frac{138}{2} \log_{10} \frac{D}{d}$$

$$\frac{100}{138} = \log_{10} \frac{D}{d}$$

if $D = .375$ inch then $$.7426 = \log_{10} \frac{.375}{d}$$

$$d = .0707 \text{ inch}$$

where "$Z_o$" is the impedance designed for, in this case 50 ohms, "D" is the diameter of the outside sleeve 108, "d" is the diameter of the center conductor sleeve 106, and "Er" is the dielectric constant of the dielectric cylindrical sleeve 104. The diameter of the dielectric sleeve 104 can be any size that will allow for it to fit within outside sleeve 108 and center conductor sleeve 106 while taking into account the thickness of the dielectric sleeve 104. By making the dielectric out of nylon, or acetal material having a dielectric constant of 4.0, and designing for a D of 0.375 inch, we calculate a "d" equalling 0.0707 inch. Although nylon is the preferred material for the dielectric, other similar materials may be utilized. Both the outside sleeve 108 and center conductor sleeve 106 can be formed from an electrically conductive material such as aluminum, or another metal which is easily extruded into a cylindrical shape. The center conductor sleeve 106 and outside sleeve 108 are electrically insulated from each other by dielectric sleeve 104.

The length of antenna 114 for an operating frequency of 450 Mhz can be easily calculated by the following formula:

$$L_x = \frac{300 \times 10^6}{450 \times 10^6} \text{ meters} = .667 \text{ meters.}$$

If designing for a quarter wave length antenna element 114:

$$L_{x/4} = 0.667/4 = 16.67 \text{ centimeters} = 6.56 \text{ inch.}$$

Due to end "effects", the practical physical length of antenna element will approach closer to 6.25" inch at 450 Mhz. Depending on the operational frequency being designed for, the length, diameters, path impedance, and dielectric constant, will require appropriate recalculations of the above formulas in order to achieve maximum operational results. Antenna element 114 could be designed as a quarter wavelength as in the preferred embodiment, ⅝ wavelength or any other practical size. Also, antenna element 114 can be designed as a single piece element or as a telescoping antenna element.

Figure 3:
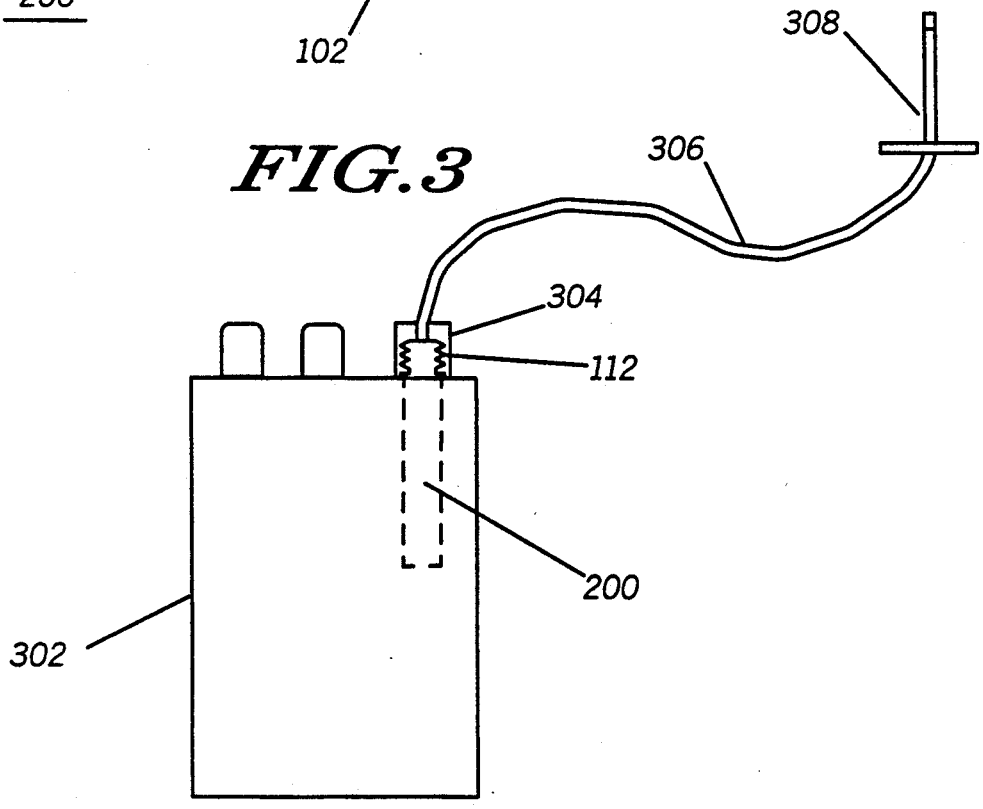
In FIG. 3 a radio utilizing an antenna assembly in accordance with the present invention is shown.

In FIG. 3, a radio 302 utilizing the antenna assembly 200 of the present invention is shown. Radio 302 includes a conventional receiver and transmitter (not shown) which are selectively coupled to antenna assembly 200 via an antenna switch which is in turn coupled to RF cable 110. A mobile mount antenna 308 (external antenna) is shown connected to the connector means 112 of antenna assembly 200. In this particular example, a conventional UHF connector 304 is used to connect mobile antenna 308 to radio 302. A conventional coaxial antenna such as a 50 ohm coax 306 is utilized to connect between radio 302 and mobile antenna 308 which is typically mounted on the outside of a vehicle.

Although the preferred embodiment has shown housing 144 formed using a center conductor sleeve 106 one could just as well not use the center conductor sleeve 106 and rely on the antenna element 114 to form the half wave transmission line (cavity) when retracted into the recess area 134. The benefit of having the center conductor sleeve 106, connected to the center conductor 132 of the RF path is that then one can then use a telescoping antenna when in the first or active (up) position which closes down to a different size when inside of cavity area 134.

In summary, the present invention provides for a simple way of "disconnecting" an antenna element 114 from a radio 300, by simply retracting the antenna element into a housing 144 which is part of the antenna assembly 200. Once in the retracted mode, a connector means 112 is formed, which allows the radio user to attach a new antenna element 308 without having to remove the original antenna element 114. Another benefit of the present invention is that a quarter wave ground plane is formed when antenna element 114 is in the first or active position, making the quarter wavelength antenna element 114 resemble a dipole antenna, thereby providing better gain characteristics.

What is claimed is:

1. An antenna assembly, comprising:

a housing having first and second ends, the housing including a conductive sleeve and a dielectric sleeve which define a cavity;

an antenna feed point located closer to the first end of the housing;

an antenna element coupled to the antenna feed point and carried by the housing, the antenna element being movable between a first position wherein the antenna element forms an active antenna portion and a second position substantially within the cavity wherein the antenna element exhibits a high impedance with respect to the antenna feedpoint, the antenna element including a first connector contact; and a connector means coupled to the housing at the first housing end for providing a second connector contact, the first and second connector contacts form an antenna connector when the antenna element is in the second position.

2. The antenna assembly of claim 1, wherein the antenna element operates at a predetermined frequency and the antenna element in the second position exhibits a halfwave resonance at the predetermined frequency of operation which causes the antenna element to exhibit a high impedance with respect to the antenna feedpoint when the antenna element is substantially within the cavity.

3. The antenna assembly of claim 1, wherein the first and second connector contacts form a coaxial connector.

4. The antenna assembly of claim 1, wherein the antenna element comprises a quarter wave length antenna element when in the first position.

5. The antenna assembly of claim 1, wherein the antenna element comprises a telescoping antenna element.

6. The antenna assembly of claim 1, wherein the housing includes an outside sleeve which is at ground potential and a center conductor sleeve coupled to the antenna feedpoint, the dielectric sleeve being located between the outside sleeve and the center conductor sleeve.

7. The antenna assembly of claim 6, further comprising an antenna contact means for coupling the antenna element to the center conductor sleeve.

8. The antenna assembly of claim 1, further comprising a biasing means coupled to the housing for providing the antenna element with a bias which tends to push the antenna element out of the housing.

9. An antenna assembly, comprising:

a housing having first and second ends and including an outside sleeve which is at ground potential and a center conductor sleeve coupled to the antenna feedpoint, a dielectric sleeve being located between the outside sleeve and the center conductor sleeve, the center conductive sleeve defines a cavity;

an antenna feed point located closer to the first end of the housing;

an antenna element coupled to the antenna feed point and carried by the housing, the antenna element being movable between a first position wherein the antenna elements forms an active antenna portion and a second position substantially within the cavity wherein the antenna element exhibits a high impedance with respect to the antenna feedpoint, the antenna element including a first connector contact; and a connector means coupled to the housing at the first housing end for providing a second connector contact, the first and second connector contacts forming an antenna connector when the antenna is in the second position.

10. The antenna assembly of claim 9, wherein the first and second connector contacts form a coaxial connector.

11. The antenna assembly of claim 10, further comprising:

a biasing means coupled to the housing for providing the antenna element with a bias which tends to push the antenna element out of the housing whenever a second antenna element is not connected to the coaxial connector.

12. The antenna assembly of claim 9, wherein the antenna element in the second position exhibits a halfwave resonance which operatively decouples the antenna element from the antenna feedpoint when the antenna element is substantially within the dielectric sleeve.

13. The antenna assembly of claim 12, wherein the antenna element comprises a quarter wave length antenna element when in the first position.

14. The antenna assembly of claim 9, wherein the antenna element comprises a quarter wavelength antenna element when in the first position, and the housing forms a quarter wave ground plane when the antenna element is in the first position allowing for the antenna element to exhibit the electrical characteristics of a dipole antenna.

15. A communication device, comprising;

a receiver; and an antenna assembly coupled to the receiver, the antenna assembly including:

a housing having first and second ends, the housing including a conductive sleeve and a dielectric sleeve which define a cavity;

an antenna feed point located closer to the first end of the housing;

an antenna element coupled to the antenna feed point and carried by the housing, the antenna element being movable between a first position wherein the antenna element forms an active antenna portion and a second position substantially within the cavity wherein the antenna element exhibits a high impedance with respect to the antenna feedpoint, the antenna element including a first connector contact; and a connector means coupled to the housing at the first housing end for providing a second connector contact, the first and second connector contacts form an antenna connector when the antenna element is in the second position.

16. The communication device of claim 15, wherein the antenna element operates at a predetermined frequency and the antenna element in the second position exhibits a halfwave resonance at the predetermined frequency of operation which causes the antenna element to exhibit a high impedance with respect to the antenna feedpoint when the antenna element is substantially within the cavity.

17. The communication device of claim 16, wherein the antenna element comprises a quarter wave length antenna element when the antenna element is in the first position.

18. The communication device of claim 15, wherein the first and second connector contacts form a coaxial connector when the antenna element is in the second position.

19. The communication device of claim 15, wherein the antenna element comprises a quarter wavelength antenna element when in the first position, and the housing forms a quarter wave ground plane when the antenna element is in the first position allowing for the antenna element to exhibit the electrical characteristics of a dipole antenna.

* * * * *